United States Patent [19]

Holzapfel

[11] 4,083,674

[45] Apr. 11, 1978

[54] FILM EVAPORATION COMBUSTION CHAMBER

[75] Inventor: Immanuel Holzapfel, Stuttgart, Germany

[73] Assignee: Daimler-Benz Aktiengesellschaft, Germany

[21] Appl. No.: 667,086

[22] Filed: Mar. 15, 1976

[30] Foreign Application Priority Data

Mar. 14, 1975 Germany ..... 2511171

[51] Int. Cl.[2] ..... F23D 5/06; F23D 11/04

[52] U.S. Cl. ..... 431/116; 431/183; 431/11; 431/243; 431/177

[58] Field of Search ..... 431/9, 11, 164, 166, 431/174, 182, 183, 116, 242, 243, 245, 353, 213–215, 246, 248, 177

[56] References Cited

U.S. PATENT DOCUMENTS

| | | | |
|---|---|---|---|
| 872,134 | 11/1907 | Kitching | 431/177 |
| 2,247,848 | 7/1941 | Poor | 431/214 |
| 2,857,961 | 10/1958 | Brown et al. | 431/353 |
| 2,973,808 | 3/1961 | Fox, Jr. | 431/116 |
| 3,042,105 | 7/1962 | Bitterlich | 431/174 |
| 3,174,526 | 3/1965 | Von Linde | 431/116 |
| 3,238,991 | 3/1966 | Goldmann et al. | 431/11 |
| 3,872,664 | 3/1975 | Lohmann et al. | 431/9 |

FOREIGN PATENT DOCUMENTS

| | | | |
|---|---|---|---|
| 1,157,143 | 5/1958 | France | 431/116 |

*Primary Examiner*—John J. Camby
*Assistant Examiner*—Henry C. Yuen
*Attorney, Agent, or Firm*—Craig & Antonelli

[57] ABSTRACT

A film-evaporating combustion chamber with an evaporator pipe whose inner wall surfaces are wetted with a fuel film from a fuel supply installation, and in which the evaporating fuel is seized by a swirling combustion air flow sweeping along the inner diameter of the evaporator pipe so as to mix the film with the combustion air; the fuel supply installation is thereby equipped with at least one feedline which extends from the inside toward the inner wall of the evaporator pipe and whose discharge opening is located substantially in front of the inner wall.

39 Claims, 4 Drawing Figures

FILM EVAPORATION COMBUSTION CHAMBER

The present invention relates to a film-evaporating combustion chamber with an evaporator pipe whose inner surfaces are wetted with a fuel film from a fuel supply installation and in which the evaporating fuel is seized by a swirling or rotating combustion-air flow sweeping along the inner diameter of the evaporator pipe and is mixed with the same, especially for vehicle gas turbines.

Film-evaporating combustion chambers of this type are known in the prior art (Motortechnische Zeitschrift 1959, pages 283 et seq.) On the one hand, the formation of the swirl flow and of the recirculation flow are of great significance for a good efficiency of such film-evaporating combustion chambers and on the other hand, also the manner how the fuel film to be evaporated forms at the inner wall of the evaporator pipe. It is essential that the fuel film be applied onto the inner wall of the evaporator pipe as rapidly and as uniformly as possible because only in that case a rapid evaporation and a mixing with the combustion air which takes place rapidly, are assured.

In the prior art types of construction, provision is made that the fuel enters from the outside of the evaporator pipe through a large number of radial bores or also through a ring of porous material. These types of prior art constructions entail the disadvantage that in the first case the radially inwardly directed fuel jets adhere directly at the evaporator pipe wall only under certain aerodynamic conditions and distribute themselves on the evaporator pipe in the form of a film only under these conditions. This distribution operation thereby depends decisively on the type and on the strength of the combustion air stream having a swirl or rotary movement. This entails the disadvantage that with a change of the supplied combustion air quantity, under certain circumstances also the intensity of the swirling flow may change so that the assurance no longer exists for the fact that the entire fuel supplied through the feedline is distributed also completely satisfactorily in the form of a film at the inner wall of the evaporator pipe. This is true in particular in case of use of film-evaporating combustion chamber in vehicle gas turbines where different driving conditions must exist.

In the other type of prior art construction, in which the fuel enters through a ring of porous material, the danger is not very great that the fuel reaches too far into the interior of the evaporator pipe; however, this type of prior art construction entails the disadvantage that the passing-through fuel is cracked and partly coked in the capillaries of the sintered material and that non-volatile residues clog up the capillaries.

The present invention is therefore concerned with the task to provide a fuel feed system which assures also under different driving conditions the formation of a fuel film and which nonetheless does not entail the danger that the fuel is cracked or coked in the feed means.

The present invention essentially consists in a film-evaporating combustion chamber of the aforementioned type in that the fuel feed installation is provided with at least one feedline which leads from the inside thereof to the inner wall of the evaporator pipe and whose discharge orifice is located directly in front of the inner wall. Appropriately, several feedlines which discharge distributed over the circumference are provided thereby in the form of relatively thin, small pipes so that the advantage is achieved in this manner that the fuel is thrown against the inner wall of the evaporator pipe already by its own inherent momentum and distributes itself thereat as film far-reachingly without influence of the swirling flow. In this type of construction, the fuel has to be deflected thereby at least in part by the rotating combustion air flow and has to be accelerated in the direction toward the evaporator pipe discharge and as a result thereof a portion of the area available for the evaporation is lost, even if the corresponding small feed pipes are provided at the inlet of the evaporator pipe.

It is therefore of advantage if in a construction of the film-evaporating combustion chamber in which a radial guide cascade is connected as guide wheel in the input ahead of the evaporator pipe and in which the evaporator pipe therefore possesses at the inlet an essentially radially extending inlet part, provision is made to apply the fuel through radially and axially directed small pipe portions onto this deflection area at the inlet of the evaporator pipe so that the distribution of the fuel takes place ahead of the beginning of the axially directed evaporator pipe, properly speaking, and an endless uniform film is present already at the beginning of the evaporator section.

Accordingly, it is an object of the present invention to provide a film-evaporator combustion chamber which avoids by simple means the aforementioned shortcomings and drawbacks encountered in the prior art.

Another object of the present invention resides in a film-evaporating combustion chamber in which the fuel is distributed film-like under all operating conditions.

A further object of the present invention resides in a film-evaporating combustion chamber which assures reliable operation under all operating conditions while preventing coking or cracking of the fuel in the feed system.

These and other objects, features and advantages of the present invention will become more apparent from the following description when taken in connection with the accompanying drawing which shows, for purposes of illustration only, two embodiments in accordance with the present invention, and wherein.

Figure 1:
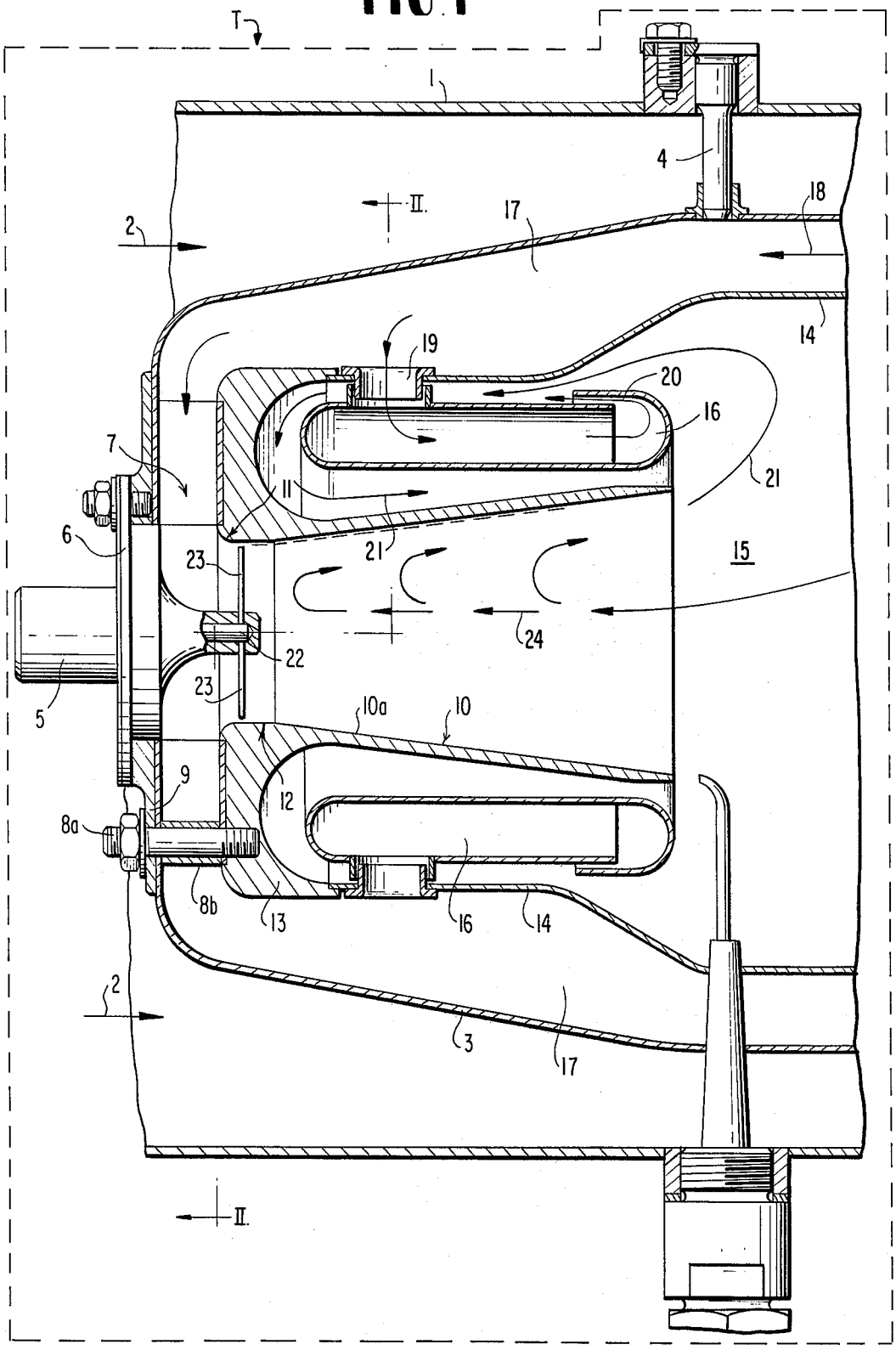
FIG. 1 is a longitudinal cross-sectional view through one embodiment of the inlet area of a film-evaporating combustion chamber in accordance with the present invention equipped with a radial guide cascade as feed device to a conically enlarged evaporating pipe.
Figure 2:
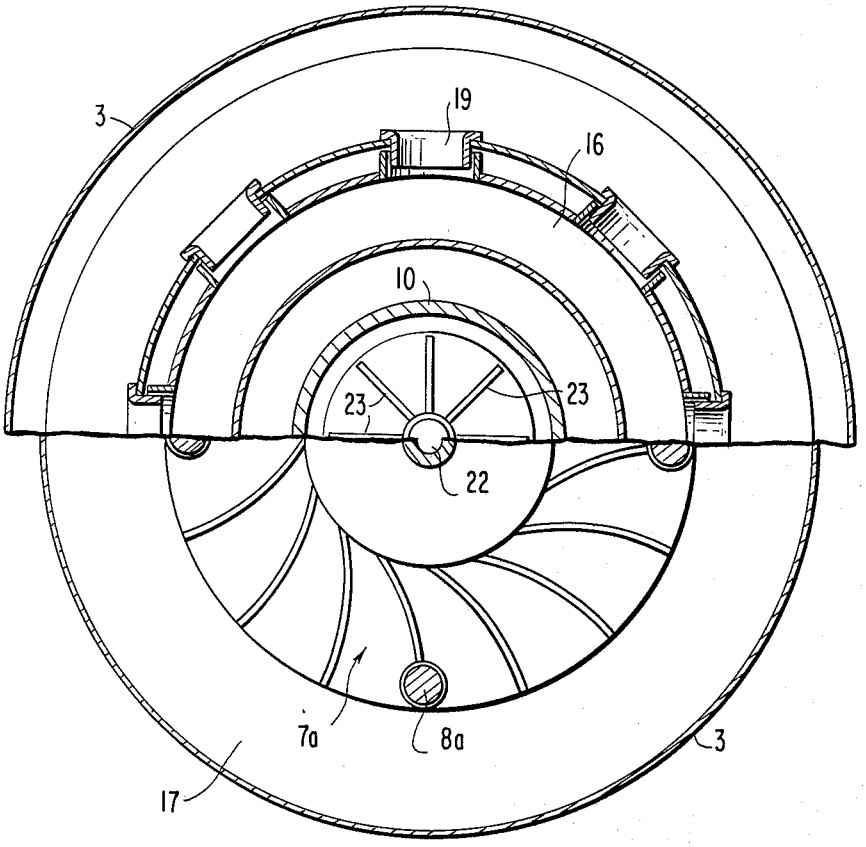
FIG. 2 is a transverse cross-sectional view taken along line II—II of FIG. 1.
Figure 4:
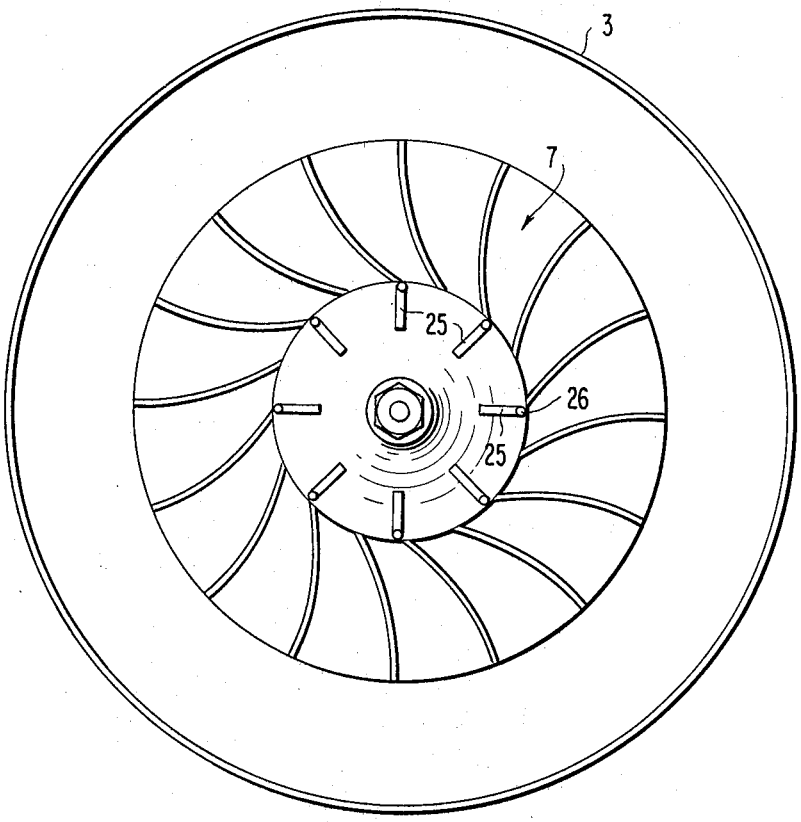
FIG. 4 is a transverse cross-sectional view taken along line IV—IV of FIG. 3.

Referring now to the drawing wherein like reference numerals are used throughout the various views to designate like parts, and more particularly to FIGS. 1 and 2, the inlet area of a film-evaporating combustion chamber of a gas turbine engine generally designated by the reference character T is illustrated in FIG. 1 which essentially consists of a pipe-shaped or tubularly shaped air guide housing 1, into which the air flows in the direction of the arrow 2. A hood 3 which is closed in the inflow direction is inserted into the air guide housing 1 which, on the one hand, is retained by several radially extending bolts 4 and on the other, is connected by way of a radial guide cascade 7 with the connecting portion 13 of an evaporator pipe generally designated by the reference numeral 10 by means of bolts 8*a* and bushes 8*b*. The member 5 is mounted at the closed end of the hood 3 on a portion 9 of the hood 3 by way of the flanged cover 6 connected with the member 5 in one piece therewith, whereby the member 5 is constructed on its side directed toward the inside of the hood 3 as deflection hub for the air discharged out of the blade channels 7*a* (FIG. 2) of the radial cascade 7. The evaporator pipe 10 includes thereby an inlet area 11 which opens essentially as inlet funnel in the direction toward the blade channels 7*a* and continues in an initially cylindrical portion 12 that is subsequently enlarged conically shaped. Toward the outside the evaporator pipe portion includes an essentially cylindrical connecting portion 13 which is adjoined by the wall 14 of a reaction chamber 15 which does not adjoin the free end of the evaporator pipe 10. An installation 16 is arranged in the annular space formed between the wall 14 of the reaction chamber 15 and the evaporator pipe 10, which in the manner of an ejector permits to the combustion air supplied through the space 17 in the direction of the arrows 18 which enters through the openings 19, to leave through an annular slot 20 and therewith produces a back-flow moving in the direction of the arrows 21 which, however, forms no part of the present invention.

The fuel to be applied onto the inner wall 10*a* of the evaporator pipe 10 is fed through a supply channel 22 extending in the center of the member 5 and is conducted radially outwardly approximately within the area of the cylindrical portion 12 of the evaporator pipe 10 through several thin, small pipes 23 having a diameter of about 0.5 to about 1 mm. The discharge orifices of the small pipes 23 are thereby located directly in front of the inner wall of the cylindrical portion 12 so that the fuel which is under pressure in the feed channel 22 is thrown against the wall of the portion 12 with a certain inherent momentum. The fuel thereby distributes itself already to a certain extent film-shaped on the inner wall, which is further enhanced by the combustion air flow which by reason of the radial guide cascade 7 has a swirling or rotating motion, insofar as a fuel film will form starting from the area 12 on the wider inner wall 10*a* of the evaporator pipe 10. The fuel film then evaporates and the evaporating fuel is taken along by the swirling flow, mixes with the combustion air and reacts in the reaction space 15 while developing heat, whereby the return-conveyance of the heat into the inlet area of the evaporator pipe 10 takes place, on the one hand, essentially by convective heat-exchange by a back-flow in the center of the swirling or rotating hollow jet approximately in the direction of the arrow 24 and, on the other, however, also in the direction of the arrow 21 on the outside of the evaporator pipe 10 where the back-flow proceeds controlled by the installation 16.

The feed channel 22 may be provided in a conventional manner not illustrated in detail at the end face of the member 5, with connections for the main fuel and for the ignition fuel and additionally also with a compressed air connection which assures in the case of shutting-down the film-evaporating combustion chamber, that the fuel which is still present in the fuel feed channel 22 and above all in the small pipes 23 is blown out so that a cracking or coking of fuel residues in this area is precluded.

Figure 3:
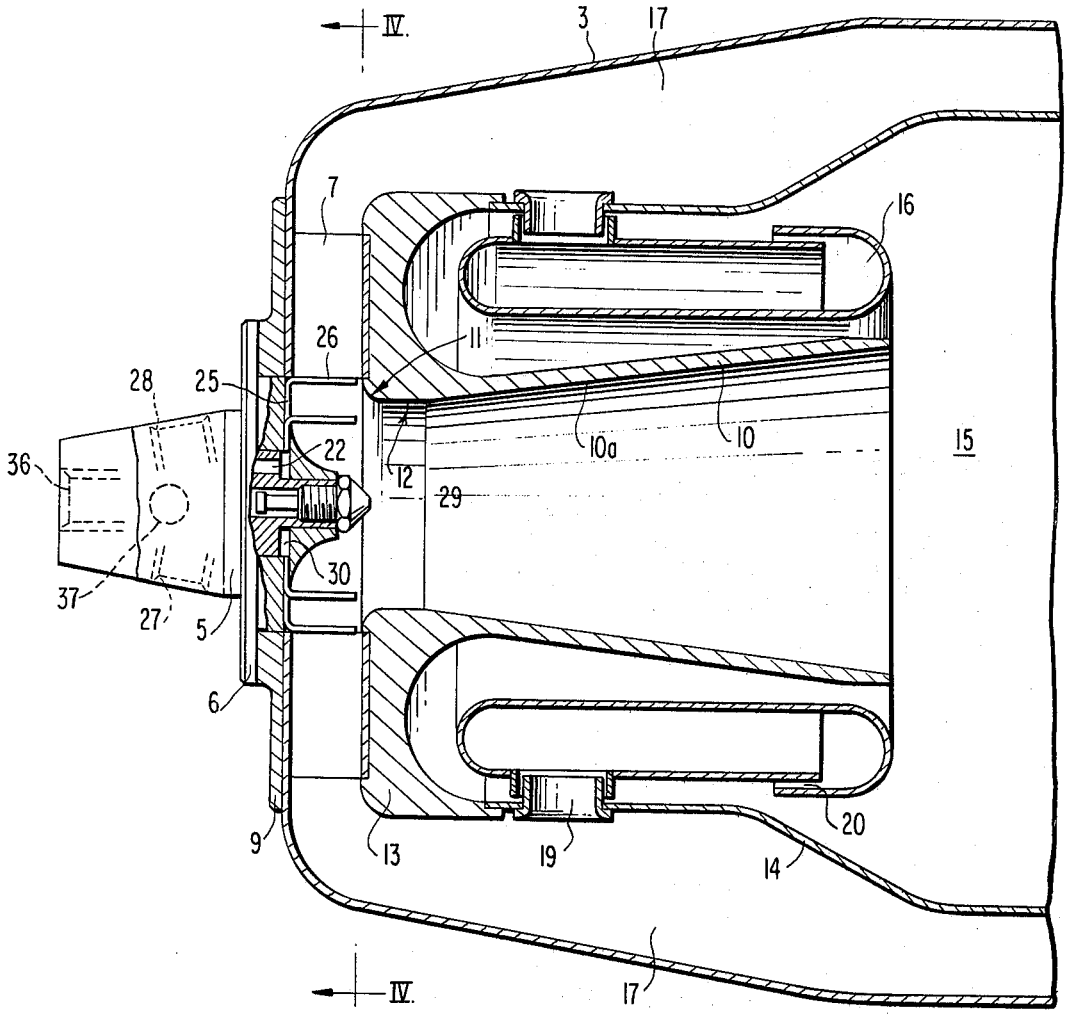
FIG. 3 is a longitudinal cross-sectional view through a modified embodiment of a film-evaporating combustion chamber in accordance with the present invention equipped with a modified fuel feed system.

A modification of the embodiment described in connection with FIGS. 1 and 2 is illustrated in FIG. 3 insofar as in that case initially a radial portion 25 of fuel feedlines extending from the feed channel 12 is embedded in the material of the member 5 and in that this radial portion 25 of the small feed pipes then passes over again into an axially directed portion 26 whose discharge orifice is located again directly in front of the inner wall 10*a* of the evaporator pipe 10, however, in this embodiment still ahead of the deflection area 11 and ahead of the cylindrical portion 12. In this manner the fuel wets the surface of the evaporator pipe 10 already ahead of the beginning of the evaporator section, properly speaking, so that a uniform fuel film is formed already ahead of the beginning of the available evaporator section, especially also because the fuel can be pressed well against the walls at this deflection place by the flow, so that the assurance exists for a good evaporation and a rapid mixing. As can also be seen from FIG. 3, the member 5 may be provided with two connections 27 and 28 for the main fuel and the ignition fuel whereby one of the two connections may also be selectively connected by way of a conventional valve 37 with a compressed air connection 36. The ignition fuel may thereby enter in this embodiment, not through the small feed pipes 25 and 26, but instead through an atomizing nozzle 29 so that only after the starting of the combustion chamber one switches over to the main fuel which is then applied by way of the small pipes 25 and 26. The feed channel 22 which in this embodiment terminates in an annular space 30 that is located still on the inside of the member 5, then has to be fed with compressed air after turning-off the combustion chamber, so that the small pipes 25 and 26 are cleaned of any residual fuel.

While I have shown and described only two embodiments in accordance with the present invention, it is understood that the same is not limited thereto but is susceptible of numerous changes and modifications as known to those skilled in the art and I, therefore, do not wish to be limited to the details shown and described herein but intend to cover all such changes and modifications as are encompassed by the scope of the appended claims.

I claim:

1. A film-evaporating combustion chamber, comprising an evaporator pipe means having inner wall surfaces wetted with a fuel film from a fuel feed means and means for producing a swirling combustion air flow, in which evaporating fuel is seized by the swirling combustion-air flow sweeping along an inner diameter of the evaporator pipe means with the evaporating fuel being mixed with the combustion-air flow, characterized in that the fuel feed means includes at least one feedline means which extends from an inside of the evaporator pipe means toward an inner wall means of the evaporator pipe means, a discharge opening of the feedline means being located in one of an inlet area of the evaporator pipe means or an area substantially directly in front of the inlet area of the evaporator pipe means.

2. A film-evaporating combustion chamber according to claim 1, characterized in that the combustion chamber forms part of a vehicle gas turbine.

3. A film-evaporating combustion chamber according to claim 1, characterized in that several feedline means distributed over a circumference of the evaporator pipe means are provided.

4. A film-evaporating combustion chamber according to claim 3, characterized in that relatively thin, small pipes are provided as feedline means.

5. A film-evaporating combustion chamber according to claim 4, characterized in that each of the small pipes extend radially from an area of a longitudinal axis of the evaporator pipe means toward the inner wall means thereof.

6. A film-evaporating combustion chamber according to claim 5, characterized in that the small pipes are provided at the inlet area of an evaporator pipe means.

7. A film-evaporating combustion chamber according to claim 6, characterized in that said means for producing a swirling flow of combustion air includes a guide wheel located upstream of the evaporator pipe means, and in that the small pipes are directed from a hub of the guide wheel toward the inner wall means.

8. A film-evaporating combustion chamber according to claim 7, with a radial guide cascade as the guide wheel, characterized in that the small pipes extend from a feed channel means provided in a center of the radial guide cascade.

9. A film-evaporating combustion chamber according to claim 8, characterized in that the small pipes are embedded at least partly in a member forming part of the fuel feed means.

10. A film-evaporating combustion chamber according to claim 9, characterized in that radially extending portions of the small pipes are embedded in said member and the fuel is conducted through substantially axially directed small pipe portions onto a deflection area at the inlet of the evaporator pipe means.

11. A film-evaporating combustion chamber according to claim 8, characterized in that the feed channel means includes a main fuel connection and an ignition fuel connection, and in that one of the main fuel connection and ignition fuel connection is selectively connectable with a compressed air connection.

12. A film-evaporating combustion chamber according to claim 8, characterized in that the feed channel means includes a connection means for supplying a main fuel, the main fuel connection means is selectively connectable with a compressed air connection, and in that ignition fuel is conducted through a separate channel and an atomizing nozzle.

13. A film-evaporating combustion chamber according to claim 1, characterized in that relatively thin, small pipes are provided as feedline means.

14. A film-evaporating combustion chamber according to claim 13, characterized in that the small pipes extend radially from an area of a longitudinal axis of the evaporator pipe means toward the inner wall means thereof.

15. A film-evaporating combustion chamber according to claim 13, characterized in that the small pipes are provided at inlet area of the evaporator pipe means.

16. A film-evaporating combustion chamber according to claim 13, characterized in that said means for producing a swirling flow of combustion air includes a guide wheel located upstream of the evaporator pipe means, and in that the small pipes are directed from a hub of the guide wheel toward the inner wall means.

17. A film-evaporating combustion chamber according to claim 16, with a radial guide cascade as the guide wheel, characterized in that the small pipes extend from a feed channel means provided in a center of the radial guide cascade.

18. A film-evaporating combustion chamber according to claim 13, characterized in that the small pipes are embedded at least partly in a member forming part of the fuel feed means.

19. A film-evaporating combustion chamber according to claim 18, characterized in that radially extending portions of the small pipes are embedded in said member and the fuel is conducted through substantially axially directed small pipe portions onto a deflection area at the inlet of the evaporator pipe means.

20. A film-evaporating combustion chamber according to claim 13, characterized in that the feed channel means includes a main fuel connection and an ignition fuel connection, and in that the feed channel means is selectively connectable with a compressed air connection.

21. A film-evaporating combustion chamber according to claim 13, characterized in that the feed channel means includes a connection means for supplying a main fuel, the main fuel connection means is selectively connectable with a compressed air connection, and in that ignition fuel is conducted through a separate channel and an atomizing nozzle.

22. A combustion arrangement comprising:

a combustion chamber means for combusting a fuel air mixture, means for producing a swirling combustion air flow, means for supplying a fuel under pressure to said combustion chamber means, a fuel evaporator pipe means for evaporating fuel supplied by said fuel supplying means, said fuel evaporator pipe means includes an inlet area, an inner wall area adjoining said inlet area, and a discharge end communicating with said combustion chamber means, and at least one fuel feed line means communicating with said fuel supplying means for feeding fuel to said evaporator pipe means, said fuel feed line means terminating in at least one discharge opening means for discharging the fuel directly against a portion of the evaporator pipe means so that the fuel is distributed as a film along said inner wall area, said portion of the evaporator pipe means against which the fuel from the discharge opening is directed being one of the inlet area of the evaporator pipe means or an area of the evaporator pipe means substantially directly in front of said inlet area.

23. The arrangement of claim 22, wherein a plurality of fuel feed line means are provided and are circumferentially distributed about said fuel supplying means, each of said feed line means terminating in at least one discharge opening means for discharging the fuel directly against a portion of the evaporator pipe means.

24. The arrangement of claim 23, wherein said plurality of feed line means extend radially outwardly from a longitudinal axis of the evaporator pipe means.

25. The arrangement of claim 24, wherein said means for producing a swirling flow of combustion air are arranged upstream of the inlet area of the evaporator pipe means and direct said swirling flow into said evaporator pipe means.

26. The arrangement of claim 25, wherein said means for producing a swirling flow of combustion air and directing said swirling flow into said evaporator pipe means includes a guide means having a plurality of blade channels and an air deflection hub means.

27. The arrangement of claim 26, wherein said means for supplying fuel includes a supply channel arranged in said air deflection hub means, said plurality of fuel feed line means being arranged about a circumference of said hub means in communication with said supply channel.

28. The arrangement of claim 27, wherein said means for supplying fuel further includes a main fuel connection means for supplying operating fuel for the combustion chamber means, and an ignition fuel connection means for supplying an ignition fuel to the combustion chamber means.

29. The arrangement of claim 22, wherein said at least one fuel feed line means is embedded in a member forming a portion of said fuel supplying means.

30. The arrangement of claim 29, wherein said at least one fuel feed line means includes a radially directed line portion and an axially directed line portion terminating in said at least one discharge opening means, and wherein said radially directed line portion is embedded in said member forming a portion of said fuel supplying means.

31. The arrangement of claim 29, wherein a plurality of fuel feed line means are provided and are circumferentially distributed about said member forming a portion of said fuel supplying means, each of said fuel feed line means including a radially directed line portion and an axially directed line portion, and wherein each of said radially directed line portions is embedded in said member forming a portion of said fuel supplying means.

32. The arrangement of claim 31, wherein said fuel supplying means further includes a main fuel connection means for supplying operating fuel for the combustion chamber means, and an ignition fuel connection means for supplying an ignition fuel to the combustion chamber means.

33. The arrangement of claim 32, wherein an atomizing nozzle means is operatively connected with said ignition fuel connection means.

34. The arrangement of claim 33, wherein said member forming a portion of said fuel supplying means includes a fuel feed channel means terminating in an annular space communicating with said plurality of fuel feed line means.

35. The arrangement of claim 22, wherein means are provided for deflecting the swirling flow into said evaporator pipe means.

36. The arrangement of claim 35, wherein said means for supplying fuel includes a fuel feed member having a supply channel arranged therein, said deflecting means being arranged at the fuel feed member between a termination point of the supply channel and the inlet area of the evaporator pipe means, and wherein a plurality of fuel feedline means are provided, said plurality of fuel feedline means being arranged about a circumference of said deflecting means in communication with said supply channel.

37. The arrangement of claim 36, wherein said supply channel terminates in an annular space defined between a portion of the fuel feed member and a portion of said deflecting means, said annular space communicating with said plurality of fuel feedline means.

38. The arrangement of claim 37, wherein each of said fuel feedline means includes a radially directed line portion and an axially directed line portion, each of said radially directed line portions being arranged in said fuel feed member.

39. The arrangement of claim 38, wherein said fuel supplying means further include an ignition fuel connection means for supplying a quantity of ignition fuel to the combustion chamber means, and wherein an atomizing nozzle means is operatively connected with said ignition fuel connection means.

* * * * *